US005086722A

United States Patent [19]

Sloope et al.

[11] Patent Number: 5,086,722

[45] Date of Patent: Feb. 11, 1992

[54] TRANSIENT DAMAGE STRATEGY

[76] Inventors: Charles E. Sloope, 4657 Morris Rd.; John H. Kurtz, 4649 Morris Rd., both of Jacksonville, Fla. 32225

[21] Appl. No.: 704,225

[22] Filed: May 22, 1991

Related U.S. Application Data

[63] Continuation-in-part of Ser. No. 556,380, Jul. 23, 1990, abandoned.

[51] Int. Cl.[5] ..... B63B 25/08

[52] U.S. Cl. ..... 114/74 R

[58] Field of Search ..... 114/65 R, 72, 74 R, 114/74 T, 74 A

[56] References Cited

U.S. PATENT DOCUMENTS 3,812,807 5/1974 Ando ..... 114/74 R 3,868,921 3/1975 Seymour et al. ..... 114/74 R

FOREIGN PATENT DOCUMENTS 2031905 1/1971 Fed. Rep. of Germany .... 114/74 R

OTHER PUBLICATIONS

"Marine Journal" Spill-Proof Oil Tankers ?, Marine Engineers' Beneficial Assoc. Washington, D.C., 9-1989.

*Primary Examiner*—Jesus D. Sotelo

*Assistant Examiner*—Stephen P. Avila

[57] ABSTRACT

Transient Damage Strategy (TDS), for waterborn cargo and passenger vessels, functions to prevent or to greatly mitigate pollution of waters, and to reduce hazarding of stability and buoyancy of ships subsequent to underwater penetration of tanks and other water, oil, and air tight spaces. The TDS process, which incorporates the use of existing ship's systems and is comprised of common "off the shelf" components, with the exception of one valve, herein referred to as a "ventlock" valve, effectively functions to prevent liquid tank contents, such as oil, from escaping outboard through underwater hull penetration, to prevent water intrusion into empty spaces through underwater hull penetration, and to enable transfer of uncontaminated oil or other contents from damaged tanks to undamaged tanks.

17 Claims, 12 Drawing Sheets

A-A

B-B

TRANSIENT DAMAGE STRATEGY

This is a application of Ser. No. 556,380 filed Jul. 23, 1990 and now abandoned.

BACKGROUND OF THE INVENTION AND PROCESS

Transient Damage Strategy (T D S) is a process that functions to effectively and economically alleviate critical safety, ecological, and commercial deficiencies presently existing within the waterborn transportation industry.

TDS is a process that addresses the problems of loss of ships tank contents into waters, and intrusion of water into ships tanks, and provides, as near as is practicable, viable, and reliable solutions therefore.

It is recognized that ship's liquid loaded tanks must be provided with unrestricted vents to preclude over pressurization that would otherwise result from expansion and contraction of tank contents, and to allow for filling and emptying of tanks, and it is recognized that, subsequent to underwater penetration of tanks, free communication of ambient air or other influencing medium, through tank vents or other tank penetrations allows rapid flooding of empty tanks, and/or loss of that portion of tank contents above the water level, thereby contributing to pollution and degradation of ship's stability and buoyancy.

Commercial vessels employed in the transportation of petroleum products are particularly susceptible to rapid loss of large quantities of cargo due to the requirement to maintain ullage areas of tanks inerted to an over pressure of approximately 1.5 psi above atmospheric pressure, whereby, upon penetration of the tank below the outside water level, outboard flow of tank contents is compelled to occur at a faster rate and to a greater extent.

Control of and/or recovery from extensive under water hull damage by implementation of classic damage control procedures, as employed on most war ships, is not realistic in the area of merchant shipping where economics require near total automation of ship operation and proportional reduction of manning levels. Further, it has been demonstrated that distant located personnel and equipments, which are dedicated to assisting merchant vessels in containment and recovery of spilled petroleum products, are not to be relied upon to respond during the most critical early stages of casualty.

With the foregoing in mind, it follows that any practical system for preventing gross contamination of waters and shorelines, and for protection of ship stability and buoyancy, must be installed in the ship, and must be active at the moment of incident to be effective. To be viable, under merchant shipping conditions, the system must be safe, economical, reliable, easily operable, and must not require continuing maintenance, reliance on operation of ship's systems, or continuing detraction of personnel from other duties.

As it was determined that no single system or piece of equipment could meet requirements of preceding paragraph, TDS was developed by considering each element of the overall problem with ends to elemental solution and to ultimate combining of all elements of the solution into a cohesive and comprehensive process which, in addition to considering solution of problems, considers that the system must be versatile enough to be effective when, due to unforeseen circumstances, predetermined solutions are not totally valid.

DESCRIPTION OF THE PROCESS

TDS essentially consists of two (2) primary elements defined as, one (1); the ventlock system, and two (2); the high tank suction system, and one (1) secondary element defined as the control system, which integrates the first two elements with existing ship's systems, and provides the capability to establish component operational sequencing unique to the liquid load of each ship.

TDS employs existing ship's systems, whenever possible, as a means of precluding unnecessary redundancy, which would otherwise increase installation, and maintenance costs, and to facilitate casualty recovery while maintaining uninterrupted protection. Specific existing systems employed include low pressure air, electric transfer pumps (when installed), piping and valving, and control systems therefore.

TDS is designed to be easily, and instantly activated by any member of the ship's crew, without any prior training, and to be entirely operable within existing duties of the ship's officers and crew.

The "Ventlock System", is identified as the first element of TDS, and functions to establish positive closure of tank vent(s), and other tank penetrations, such that the portion of the tank above the liquid load level (the ullage area) is sealed, and thereby protected against the influence of outside pressure(s).

Activation of the ventlock system to the highest state of readiness to resist the effects of underwater damage is independent of other ship's systems, in that it does not rely on ship's power for operation, and does in fact establish the highest state of readiness upon intentional activation, or upon loss of ship's power. Thus, the ventlock system is an independent "fail safe" system, which stands alone as the most reliable primary protection against gross pollution of waters and degradation of ship's stability and buoyancy.

The Ventlock System alone, will provide the following immediate effects, upon penetration of a tank below the outside water level.

1. Greatly reduce amount and velocity of tank content flow outboard, through the penetration, due to the natural laws of physics, which cause rapid equalization of pressures at the penetration as the result of immediate formation of static vacuum in the ullage area of the sealed tank.

2. Tanks that are protected by an inerting system will very slightly below those that are not, due to the inerting over pressure that was sealed into the tank upon setting of the ventlock system, however the over pressure will have minimal effect, and the static vacuum formed will be sufficient to maintain the column of oil, or other liquid, at near the height above the water level as prior to damage.

3. Greatly reduced amount of water intrusion into empty tanks, due to rapid equalization of pressures at the penetration resulting from increased pressure within the tank, which is caused by incoming water compressing trapped air. Equalization of pressures will occur as incoming water reaches a point just above the penetration.

The "High Tank Suction System" is identified as the second element of TDS, and functions to establish pump suction on tank contents at a point above which underwater penetration of the tank will occur, and above which the normal tank suction will have become submerged by intruding water. The high tank suction system stands alone as the only means of selectively removing large quantities of uncontaminated tank contents from damaged tanks, thereby precluding pollution of waters, and retaining valuable cargo.

Immediate effects realized upon establishing high tank suction on a tank, when the tank is protected from influence of outside pressures by activation of the ventlock system, include the following.

1. The effect on an undamaged tank will be to remove a slight amount of tank contents, the amount of tank content removed being relative to pressure established by tank content column height above point of suction, and by pump suction pressure, thereby reducing the pressure in the ullage area of the tank, and the pressure of tank contents at all points below the outside water level.

2. The effect on a tank that is protected by an inerting system will be to remove slightly more volume of tank content, than in para. 1. above, due to the inerting system over pressure. Reduction of pressure in the ullage area of a tank, so long as intrusion of oxygen is prevented, will not hazard the vessel by increasing probability of establishing a combustible atmosphere.

3. The effect on a tank that is protected as in paragraphs 1. and 2. above, upon sustaining underwater penetration, will be immediate establishment of a positive flow of water inboard, vice a flow of tank contents outboard, and thereby elimination of pollution of waters, and loss of liquid load.

The "Control System" is identified as the third element of TDS, and functions to combine the ventlock system, the high tank suction system, and existing ship's systems into a comprehensive and reliable strategy, thus providing the capability for automatic operational sequencing, of systems components, commensurate with the liquid load of the ship, and projected probabilities for damage.

Activation of the control system, is accomplished by pressing one (1), momentary contact, electric push-button labeled "ON", which will cause the following sequence of actions to occur automatically.

1. The ventlock system will be activated to seal the ullage areas of all pre-selected tanks against the influence of outside pressures.

2. The high tank suction valves will be opened, and low suction valves will be closed on pre-selected tanks.

3. Transfer system valves will be aligned for transfer from pre-selected tanks to receiving tanks.

4. Electric transfer pumps will be started, to run at speed necessary to reduce pressure in the pump suction manifold and all tanks aligned thereto.

5. Reduced pressure in suction manifold will cause realignment of pump discharge manifold valves for recirculation to tank that is on suction.

At this point TDS is in the highest state of readiness to prevent pollution of waters, and to resist serious degradation of stability and buoyancy. Upon sustaining underwater penetration of protected tanks, the following sequence of events will occur.

1. Transfer pump suction manifold pressure will rise, due to intrusion of water into a protected tank.

2. Increased pressure in the suction manifold will cause realignment of pump discharge manifold valves for discharge to predetermined receiving tank(s).

3. Transfer pump speed will increase to maintain suction pressure sufficient to continue flow of water inboard through tank penetration.

At this point the ship will have gained necessary time to assess damage, and to take manual control of transfer system for most advantageous distribution of tank contents, that are being removed from damaged tank(s) by high tank suction system. Immediate actions to be taken, by ship's company personnel, will include the following.

1. Isolate individual ventlock valves to damaged tank(s), such that static vacuum will be maintained therein when the ventlock system is reset on undamaged tank(s).

2. Close all suction manifold valves to undamaged tanks, so that ullage areas of undamaged tanks may be selectively filled with tank contents being transferred from damaged tanks.

3. Reset ventlock system to undamaged tanks, thereby establishing the capability to transfer contents from damaged tanks to undamaged tanks.

At this point the ship will have realized only minor, if any, pollution of waters, and it will not be necessary to secure steam or electric generating equipments to preclude contamination of condensing or other heat exchanging components. All undamaged tanks can have inerting systems restored, and the full force of installed transfer pumping systems may be brought to bear on liquid load for most advantageous arrangement, to accommodate contents removed from damaged tanks, and to insure ship stability and buoyancy.

In one of the worst case scenarios of pollution of waters by a single ship, such as the pollution of Prince William Sound, and with only the ventlock system activated, TDS would have immediately reduced the volume of oil lost by 90%+, and would have provided a means for salvage of the remainder of the cargo. In the same scenario, with the ship's steam and electric generating systems in operation and providing cargo transfer capability, the amount of oil lost would have been reduced to that amount driven out of the ship by impact. In either instance, with TDS installed pollution of Prince William Sound would have been a relatively minor incident.

TDS provides a ship the independent capability to survive, to recover from potentially disastrous underwater hull damage, and to minimize water pollution.

VENTLOCK VALVE OPERATION

The unique ventlock valve is a spring loaded, pneumatic diaphragm operated globe valve with a spring loaded relief valve incorporated into the center of the main valve disc. The diaphragm chamber is arranged such that one side houses the valve closure spring and manual opening device, and the other side is sealed to cause operation, to the open position, by applied air pressure.

During normal ship operation, to allow unrestricted tank venting, the valve is held in the open position, in opposition to spring pressure, by application of ship's service low pressure air to the operating diaphragm chamber. All ventlock valve diaphragm chambers are connected to a common air supply line which is provided pressurized air, through a solenoid operated valve, from the ship's service low pressure air main. The condition established is much like the air break systems on large vehicles, whereby loss of air pressure causes activation of the system, thus the ventlock valves, upon diversion of supply air, by shifting of the air supply valve, or due to failure of ship's service low pressure air supply, will revert, by spring pressure, to the "normally closed position" and thereby will establish the highest state of readiness to mitigate polluting effects of underwater tank penetration, and interruption of ship's stability and buoyancy.

Normal activation of the ventlock system is accomplished by electrically or manually shifting the solenoid operated low pressure air supply valve such that it closes off the air supply and vents the common ventlock valve supply line to the atmosphere. Local activation of individual ventlock valves is accomplished by shifting a 2-way 3-port plug valve, which is installed on the pneumatic diaphragm chamber, such that upon 90° rotation of the valve the supply air is shut off and the operating diaphragm chamber is vented to atmosphere.

Ventlock valves are installed in tank vents, and other tank penetrations, such that in closed position ambient air and/or other outside pressures will be on the top of the valve disc, thereby reinforcing valve disc closure upon reduction of pressure inside the protected tank, as would happen upon penetration below the water of a tank loaded to a point above the water level.

The ventlock valve is provided with a manual operating lever, in place of a valve wheel, for opening the valve in the event pressurized air is not available, air supply piping is damaged, or the ventlock valve operating diaphragm is damaged. The lever, which is contoured to the shape of the upper diaphragm chamber, is normally folded to a position against the diaphragm chamber to present a low profile, and thereby prevent deterioration and inadvertent damage.

Each ventlock valve is provided with a vacuum/-pressure gauge, installed in the body of the valve at a point between the under side of the valve disc and the protected tank. With the ventlock valve in open position, such that tank contents are subjected to ambient pressure, the vacuum/pressure gauge will indicate zero (0). With the ventlock valve closed the vacuum pressure gauge will indicate pressure differential between the tank and ambient pressure, such that a tank filled to a point above the water level, and therefore at a higher pressure at all points below the water level, upon sustaining damage below the water level, whereby free communication between the oil within the tank and the water outside the tank is established, will cause rapid equalization of tank content pressure and outside water pressure, at the point of penetration, and will therefore cause the vacuum/pressure gauge to indicate static vacuum in the ullage area of the tank. With ventlock valve(s) closed on an empty tank, wherein pressure is lower than ambient water pressure at all points below the water level, upon sustaining damage below the water level, whereby free communication between the empty tank and the water outside the tank is established, will cause the vacuum/pressure gauge to react to water intrusion and resulting compression of trapped air therein, by indication of increased pressure within the tank. Thus, the vacuum/pressure gauge is a reliable and rapid means of determining actual location and extent of underwater tank damage

HIGH TANK SUCTION OPERATION

The high tank suction is designed for transfer of tank contents from damaged tanks to other tanks within the ship that are less than full, (all independent oil tanks on ships are filled to less than 100% capacity to allow for expansion of contents during transit) or to a receiving vessel alongside the ship, and to thereby establish a condition whereby the damaged ship may safely transit costal and inland waters to a controlled offloading and repair facility without danger of foundering and/or pollution of waters. With the ventlock valve in closed position, and with transfer pumps taking high suction on the tank, whereby, static vacuum is established in the top of the tank, pressures at all points within the tank will be less than outside water pressure at corresponding points, thereby, upon penetration of the tank at a point below the surface of the outside water, establishing immediate and positive flow of water inboard from the moment of tank penetration. When sufficient tank contents have been transferred from the damaged tank to raise the water and tank content cleavage level to an acceptable point above the tank penetration, at which point pollution will not occur due to sea state and/or movement of the vessel, no further transfer is necessary.

The high tank suction stands alone as a means for controlled transfer of uncontaminated tank contents from a point above predictable water intrusion.

CONTROL SYSTEM OPERATION

The TDS control system functions to tie the ventlock system, the high tank suction system, and the ship's installed liquid load transfer and distribution systems into a cohesive process.

The control system eliminates any necessity for understanding operation of the TDS ventlock and oil transfer systems, by the person initiating activation, by reducing the necessary action of that person to manual manipulation of a single momentary contact push-button, labeled "ON". Further, once the system is activated it does not affect normal ship operation, and does not require participation of any member of the crew until such time as the ship sustains damage. Initial activation of the control system causes shifting of the solenoid operated low pressure air supply valve, in the low pressure air supply line to the ventlock system, to the position where it blocks air supply from the low pressure air main and vents air pressure from the common ventlock valve supply line, thereby causing closure of the ventlock valves which prevent intrusion of ambient air, or other pressure influencing mediums, into tanks that are full, and prevents escape of air from tanks that are empty. Initial activation also causes activation of the pump control and valve control systems, whereby electric powered transfer pumps are started, and maintained at a speed sufficient, due to ventlock of tanks on suction, to reduce pressure in the pump suction manifold and all tanks aligned thereto, and electric operated transfer valves are aligned for high tank suction and transfer of tank contents to a designated receiving tank.

At this point the lowered pressure in the transfer pump suction manifold and all tanks aligned thereto, by activation of a sensor installed in the manifold, causes valve alignment to shift from transfer to recirculation alignment, such that pump discharge is recirculated to a designated tank that has been aligned for high suction.

With transfer valve alignment for recirculation maintained by low pressure in the pump suction manifold, an increase in pressure, resulting from under water penetration of a tank that is on suction, will cause transfer system valve alignment to shift from recirculation to transfer, thus establishing transfer of oil from damaged tank(s), which results in positive flow of water inboard, and thereby precludes pollution of waters from the moment of penetration. Net results of the forgoing include preventing loss of tank contents, preventing degradation of ship's stability, and the gain of time to investigate damage and to take manual control of transfer pump and valve management without interruption of established protection.

Predetermined component operational sequencing, established by TDS, provides a ship the independent capability to control and to recover from potentially disastrous effects of severe underwater hull damage.

BRIEF DESCRIPTION OF DRAWINGS

Drawings discussed herein are labeled and referred to as figures.

DETAILED DESCRIPTION

Figure 1:
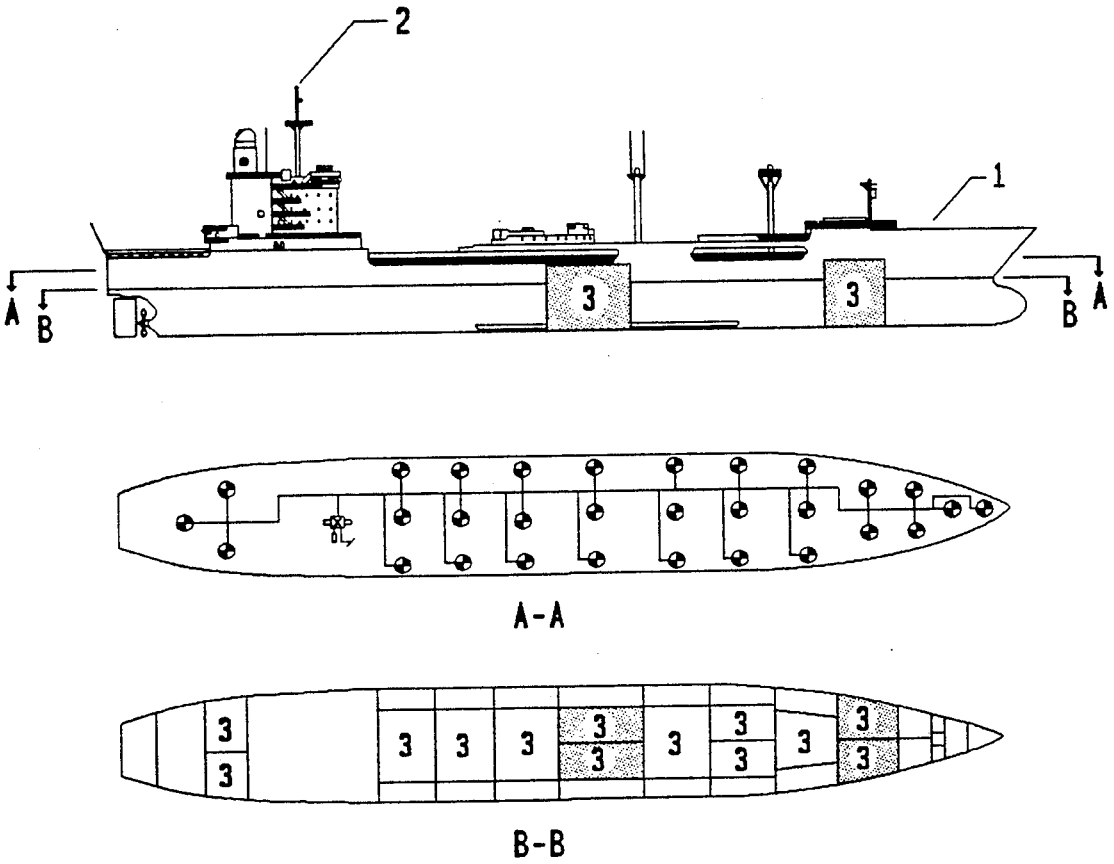
FIG. 1 is a starboard side outboard profile representation of an oil tanker, with detail cut A—A at the tank deck level and detail cut B—B at the full load waterline.

FIG. 1, outboard profile 1 indicates proposed location of 360° indicator light 2 and coupled with liquid load detail B—B shows location of oil tanks 3, with damaged tanks used for demonstration in other figures as shaded areas. Detail A—A shows ventlock valve and low pressure air supply piping arrangement at the tank deck level.

Figure 2:
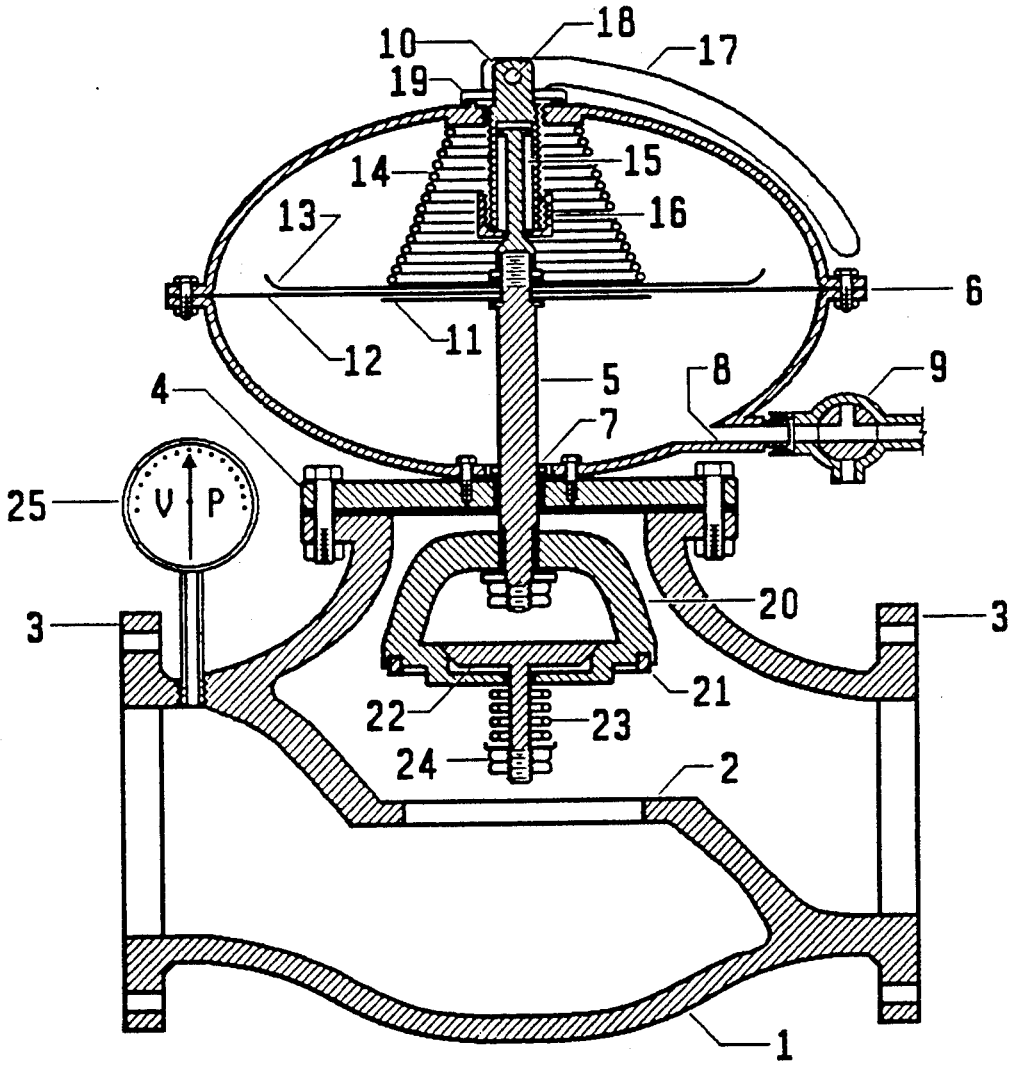
FIG. 2 is a sectional view of the ventlock valve, shown in the open position, as with air pressure applied to the diaphragm chamber.

FIG. 2, the ventlock valve, is comprised of a valve body 1, with integrally machined valve seat 2, 6-hole mounting flanges 3, a 6-hole bonnet flange 4, and it is drilled and tapped ⅛" NPT to receive vacuum/pressure gauge 25. Bonnet flange 4 is machined for clearance to receive lower valve stem 5, and is drilled and tapped in an irregular 8-hole circle to accommodate mounting of diaphragm chamber 6 such that orientation will be maintained upon assembly. Diaphragm chamber 6 is split and flanged midway to accommodate installation of internal components and to allow for mounting on bonnet flange 4. The lower part of diaphragm chamber 6 is machined to receive lower valve stem 5 and seal 7, and a threaded boss 8 is attached to accommodate 2-way 3-port plug valve 9. The upper part of diaphragm chamber 6 is drilled and tapped 1" 8 Acme threads to receive upper valve stem retractor 10 and is vented to the atmosphere to allow diaphragm operation. Diaphragm bottom plate 11, diaphragm 12, and diaphragm backup plate 13 are mounted between lower valve stem 5 and upper valve stem 15, at the center, and diaphragm 12 is mounted between upper and lower diaphragm chamber flanges at its circumference. Closure spring 14 is installed between diaphragm backup plate 13 and the center of the upper diaphragm chamber such that, in the absence of valve opening air pressure, it will maintain the valve in a closed position. With the valve in open position, as shown, the upper valve stem retractor 10 allows free movement of upper valve stem 15 and upon loss of air pressure or damage to diaphragm provides a means for opening the valve by manual retraction of the valve stem. Main valve disc 20 is attached to the lower end of valve stem 5 and is provided with a pliable gasket 21 to insure positive seal when in the closed position. Auxiliary valve disc 22 is installed in main valve disc 20 and held in closed position by spring 23. Pressure required to open auxiliary valve disc 22 is adjustable by manipulation of nuts 24 to compress spring 23 thereby establishing pressure required to open the valve at a point above that pressure required to preclude entry of water into the protected tank, in the event of underwater hull damage, and below that pressure that could hazard an undamaged tank due to expansion of contents. Lever 17 is attached to the upper valve stem retractor 10 by pin 18 and in the folded position, as shown, compresses seal 19 such that foreign materials may not enter threaded area between stem extractor 10 and threaded portion of upper section of diaphragm chamber 6. Vacuum/pressure gauge 25 is installed in valve body 1 on the inlet side of the valve between the tank and the under side of valve disc 20 such that it will indicate differential between tank pressure and ambient pressure subsequent to closure of the valve.

Normal opening of the ventlock valve is by application of low pressure air, regulated at a pressure of 50 psi, to the lower part of diaphragm chamber 6, through 2-way 3-port plug valve 9, which acts on diaphragm 12 causing it to rise, compressing closure spring 14, and thereby lifting valve stem 5 and main valve disc 20 from seat 2.

Manual opening of the ventlock valve is accomplished by folding lever 17 such that it extends away from upper diaphragm chamber 6 thereby becoming operable for counter clockwise rotation of threaded upper valve stem retractor 10 which rotation will lift the main valve disc 20 from its seat 2 by engagement at the top of upper valve stem 15 with stem retractor nut 16. The ventlock valve is operable to close remotely by venting low pressure air supply from the common supply line, locally by 90° counter clockwise rotation of 2-way 3-port valve 9 plug, and will fail to closed position upon loss of low pressure operating air or failure of operating diaphragm 12.

Figure 3:
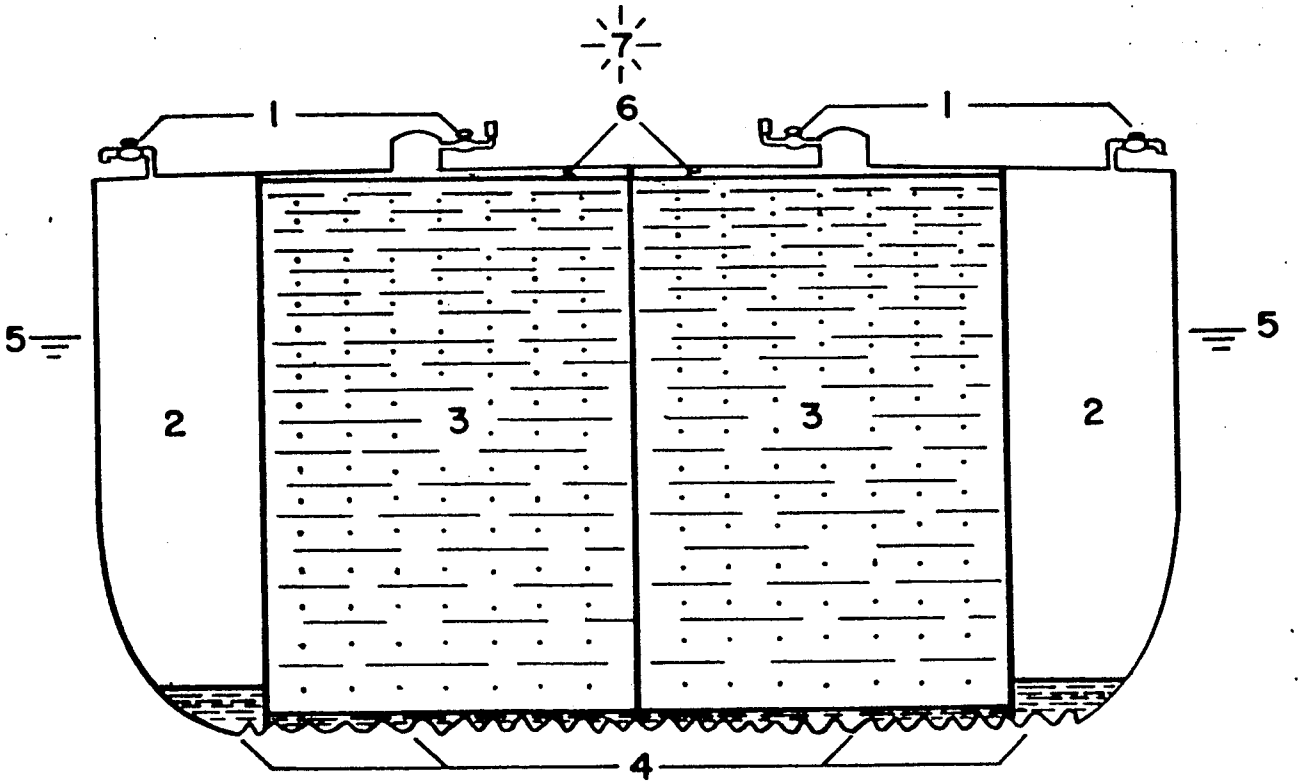
FIG. 3 represents a section of a ship's hull, indicating probable effects of massive bottom damage on full cargo oil tanks and empty clean ballast tanks which have ventlock valves installed.

FIG. 3 represents a section through a bulk oil carrying ship, which has ventlock valves 1 installed, demonstrating results to be expected from massive bottom damage to clean ballast tanks 2 and oil tanks 3, with the water level 5 as indicated. At the moment of damage, oil represented by the shaded area of tank 3, due to its height above the water level 5 and therefore its greater pressure at point of damage, will immediately try to fall to near the water level 5, while water, due to its height above the bottom of the empty ballast tank 2, will try to seek its own level within the tank. With ventlock valves 1 closed, and as the column of oil above water level 5 tries to fall, the space above the oil rapidly attains a static vacuum 6 sufficiently below atmospheric pressure 7 to nullify the pressure differential at the hull penetration which heretofore had been attributable to the difference in density and height of oil column within tank(s) 3. At this point oil has ceased to flow outboard. With ventlock valves 1 closed and water 4, represented by cross hatched areas, trying to seek its own level within ballast tanks 2 pressure of air within the tanks, due to compression by water intrusion, will rapidly cause equalization of tank pressure and water pressure at the point of penetration, and thereby preclude further tank flooding. Tank protection by ventlock valve alone can be expected to reduce content loss and associated pollution to less than 10% of load capacity, and to preclude unacceptable degradation of the vessel's stability and buoyancy.

Figure 4:
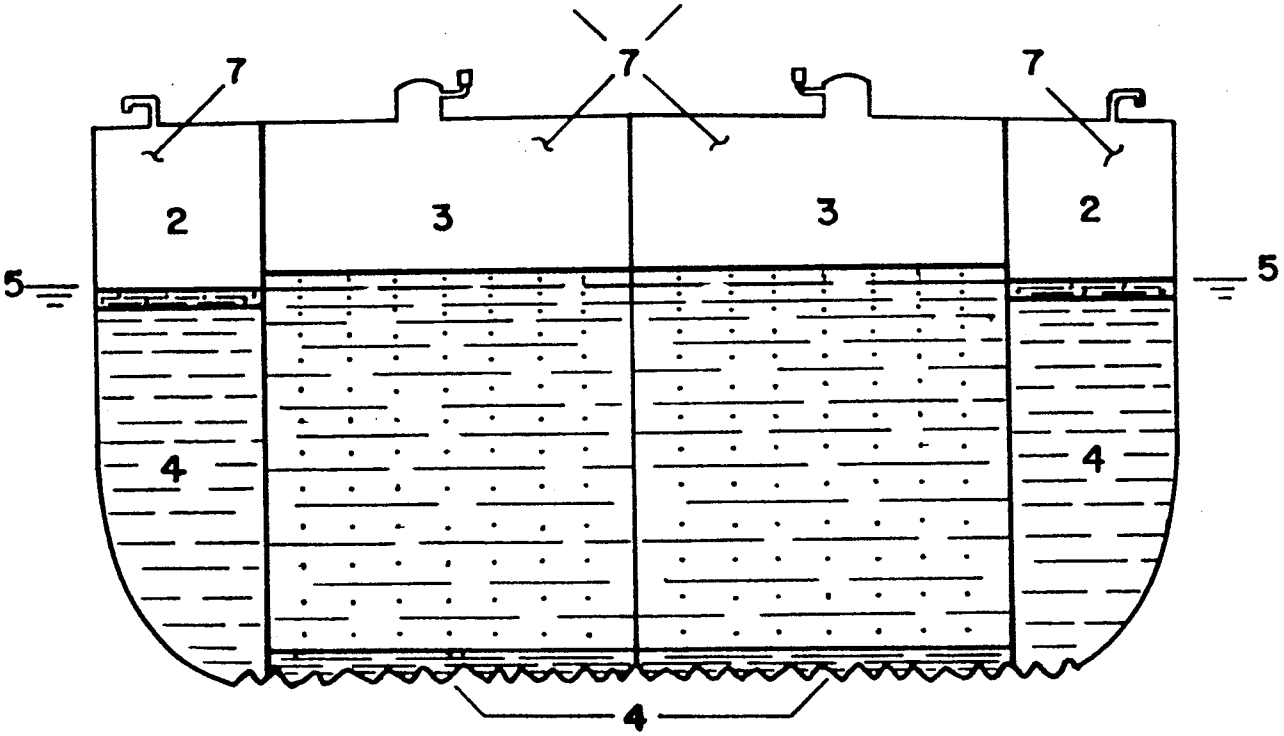
FIG. 4 represents a section of a ship's hull, indicating probable effects of massive bottom damage on full cargo oil tanks and empty clean ballast tanks which do not have ventlock valves installed.

FIG. 4 represents a section through a bulk oil carrying ship, which has unobstructed tank vents, demonstrating results to be expected from massive bottom damage to oil tanks 3 and clean ballast tanks 2, with the water level 5 as indicated. At the moment of damage oil in tanks 3, represented by shaded area, due to original height above water level 5 and therefore greater pressure at point of damage, due to atmospheric pressure 7, has fallen to near the water level 5, and water 4, due to its height above the bottom of the empty ballast tanks 2, has found its own level within the tank. Tanks 3 have lost more than 30% of cargo, and tanks 2 have flooded to water level resulting in severe pollution of waters, degradation of stability, by free communication and free surface action, and loss of buoyancy heretofore provided by tanks 2.

Figure 5:
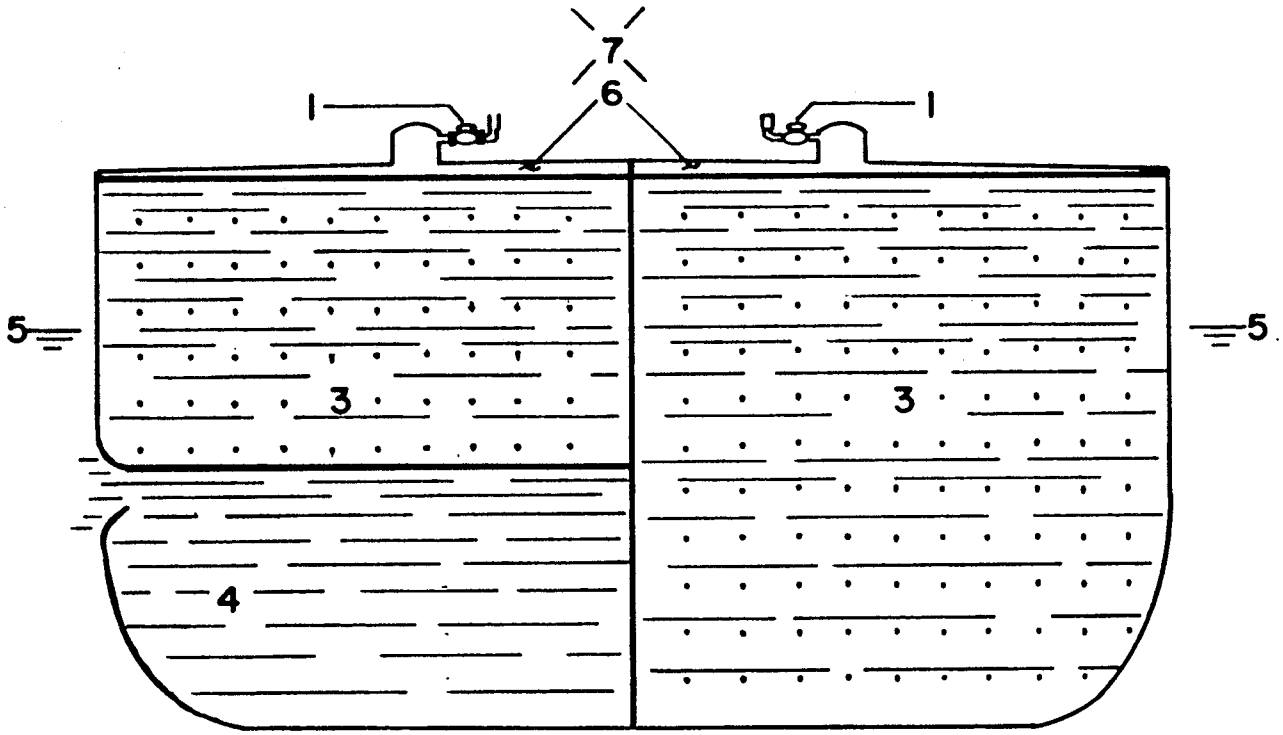
FIG. 5 represents a section of ship's hull, indicating probable effects of below the water side damage on full oil tanks which have ventlock valves installed.

FIG. 5 represents a section through a bulk oil carrying ship, which has ventlock valves 1 installed, demonstrating the probable results of side penetration. At the moment of damage to oil tank 3, due to the height of oil, represented by shaded area, above the water level 5 and therefore its greater pressure at point of damage, will immediately try to fall to near the water level 5. As the column of oil above water level 5 tries to fall, it creates a static vacuum 6 above the oil sufficient to nullify the pressure differential at the hull penetration, which heretofore had been attributable to the difference in density and height of column of oil in tank 3. The exchange of water 4, represented by cross hatch, and oil, represented by shaded area, in this demonstration is attributable to the difference in density and will cease at approximate cleavage level indicated.

Figure 6:
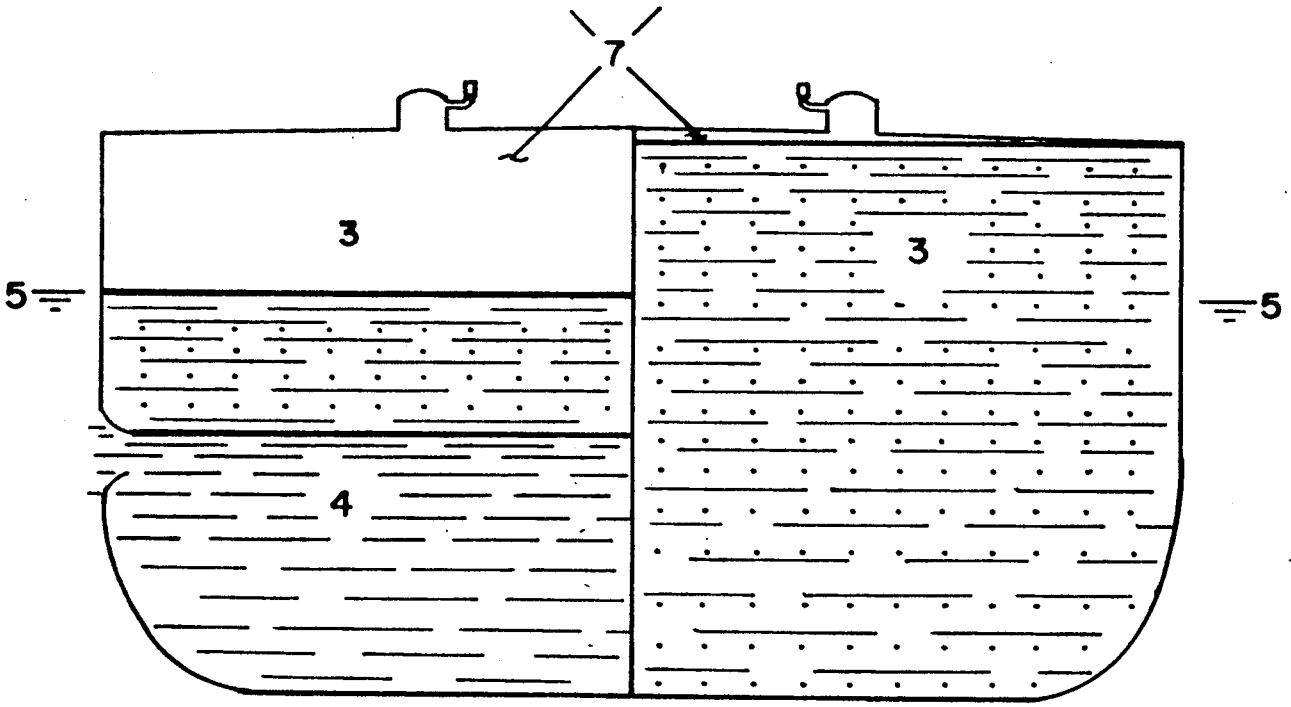
FIG. 6 represents a section of ship's hull, indicating probable effects of below the water side damage of full oil tanks which do not have ventlock valves installed.

FIG. 6 represents a section through a bulk oil carrying ship, which has unobstructed tank vents, demonstrating the probable results of side penetration. At the moment of damage, oil in the damaged tank 3, represented by shaded area, due to its original height above the water level 5 and therefore its greater pressure at point of damage, has been replaced by atmosphere 7 and has fallen to near the water level 5, and water 4, represented by cross hatch, has displaced oil to a point near the top of penetration. The ship will have lost more than 70% of the cargo in the damaged tank, pollution will be severe, ship's stability will be degraded by significant list, free communication and free surface, and buoyancy has been impaired.

Figure 7:
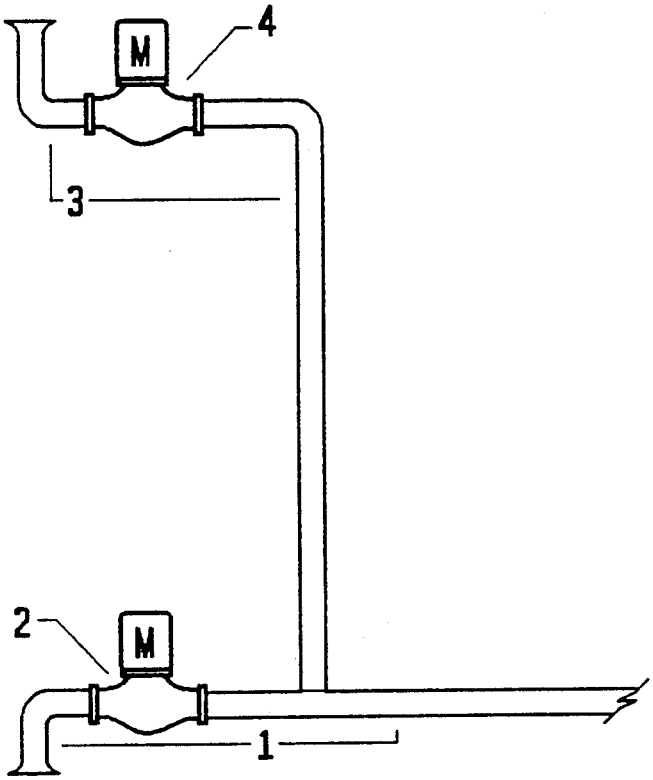
FIG. 7 represents a typical high and low tank suction piping and valving arrangement.

FIG. 7 represents typical high and low tank suction piping and valving arrangement. Piping 1 and valve 2 are typical of arrangements found in ship's tanks. Piping 3 and valve 4 are high tank suction additions to existing system.

Figure 8:
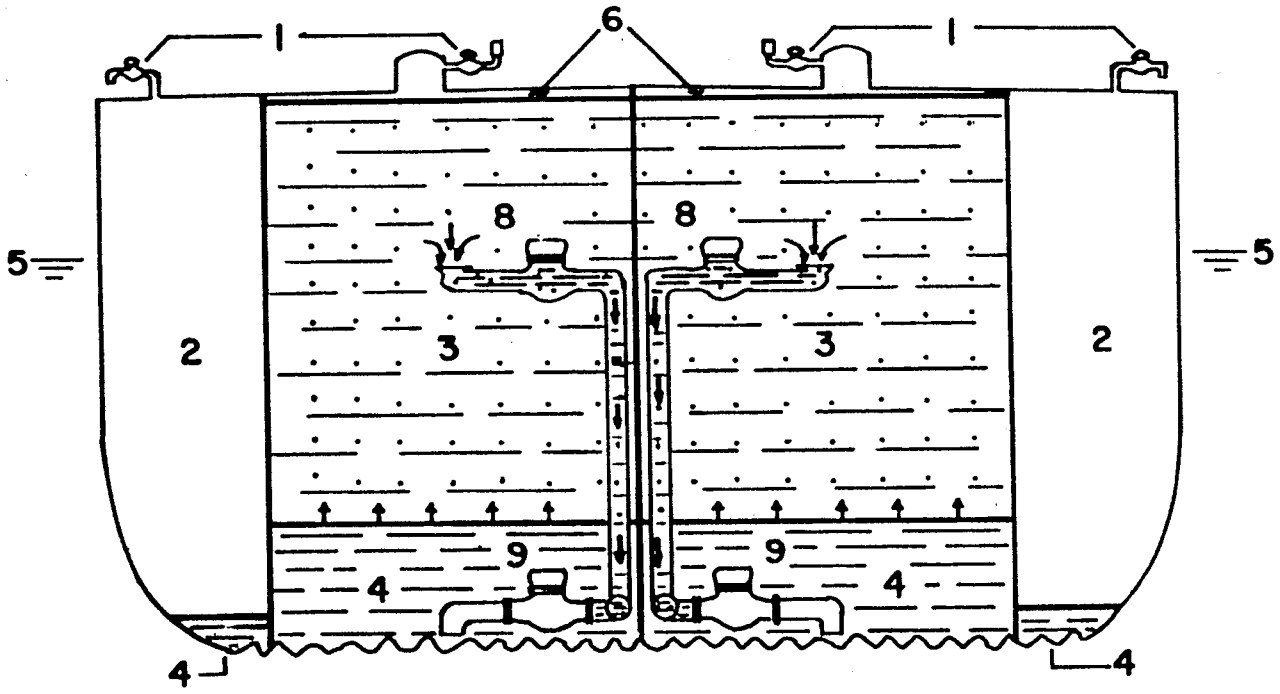
FIG. 8 represents a section of a ship's hull, indicating probable effects of massive bottom damage on full cargo oil tanks and empty clean ballast tanks which have ventlock valves and high tank suction installed.

FIG. 8 is a representation of results to be expected upon sustaining massive bottom damage with ventlock valves 1 installed and tank suction aligned for high suction by closing low suction valves 9 and opening high suction valves 8. With ventlock valves 1 closed static vacuum 6 will be established in the top of oil tanks 3 immediately upon sustaining damage, and the column of oil, represented as shaded area, will remain at near its original height above water level 5. Reduced tank pressure, established by suction of ship's transfer pumps, will cause water 4, represented by cross hatch, to displace the oil to a safe height above the penetration in tank 3. Ballast tanks 2 will become flooded with water 4 to a point at which trapped air within the tank reaches sufficient pressure to preclude further entry. With all represented tanks open to the sea, the ship retains it stability and buoyancy, lessens adverse effects of hogging and sagging, and does not pollute the water.

Figure 9:
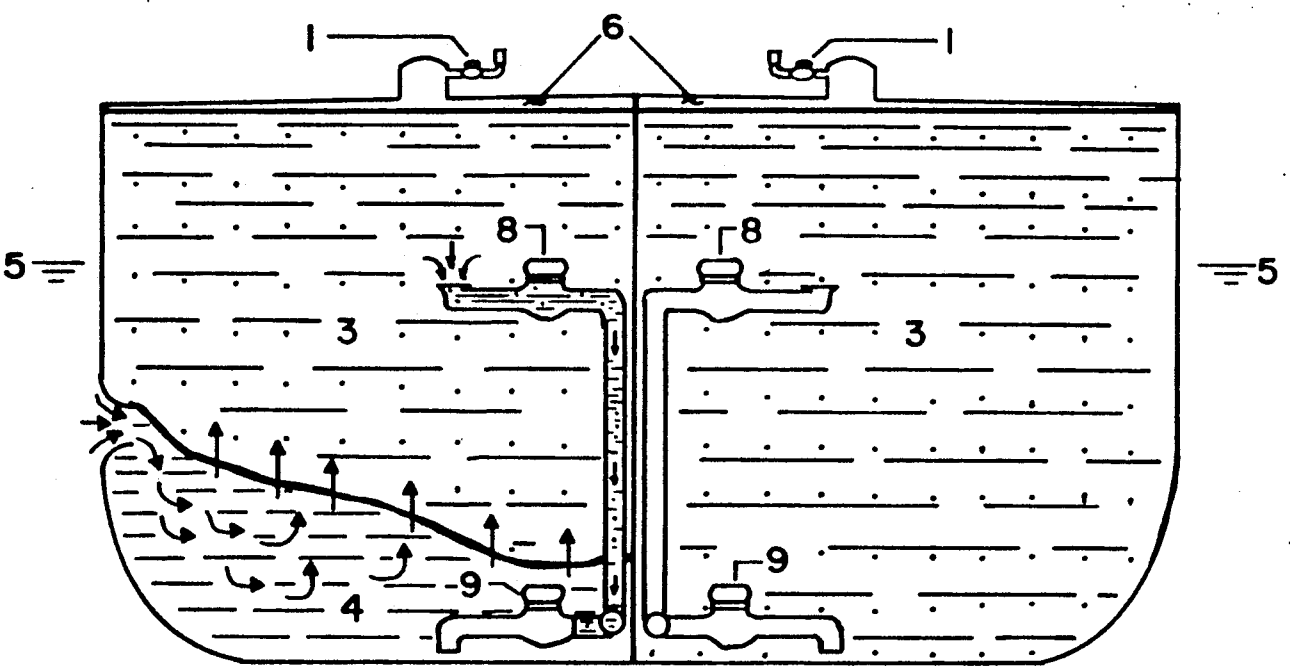
FIG. 9 represents a section of ship's hull, indicating probable effects of below the water side damage on full oil tank which has ventlock valve and high tank suction installed.

FIG. 9 represents results to be expected upon side penetration of oil tank 3 with ventlock valve 1 installed and tank aligned for high tank suction by closing low tank suction valves 9 and opening high tank suction valves 8. With ventlock valves 1, closed static vacuum 6 will be established in the top of oil tanks 3 immediately upon sustaining damage, and the column of oil, represented as shaded area, will remain at near its original height above water level 5. Reduced tank pressure, established by suction of ship's transfer pumps, will cause water 4, represented by cross hatch, to flow into tank 3 and to displace the oil, represented by shaded area, to a safe height above the penetration. While FIG. 9 represents damage similar in all respects to identical tank shown damaged in FIG. 5, a significant difference in the amount of oil lost is apparent. Due to installation of the high tank suction, shown in FIG. 7, and the restricted transfer pump suction pressure established by alignment and operation of transfer pumps in recirculation mode prior to tank penetration, loss of oil, and resulting pollution from tank 3 will range from 0% to 5%, while oil loss from similar damage shown in FIG. 5 will be 40% to 45%, and oil loss from similar damage shown in FIG. 6 will be approximately 75%.

Figure 10:
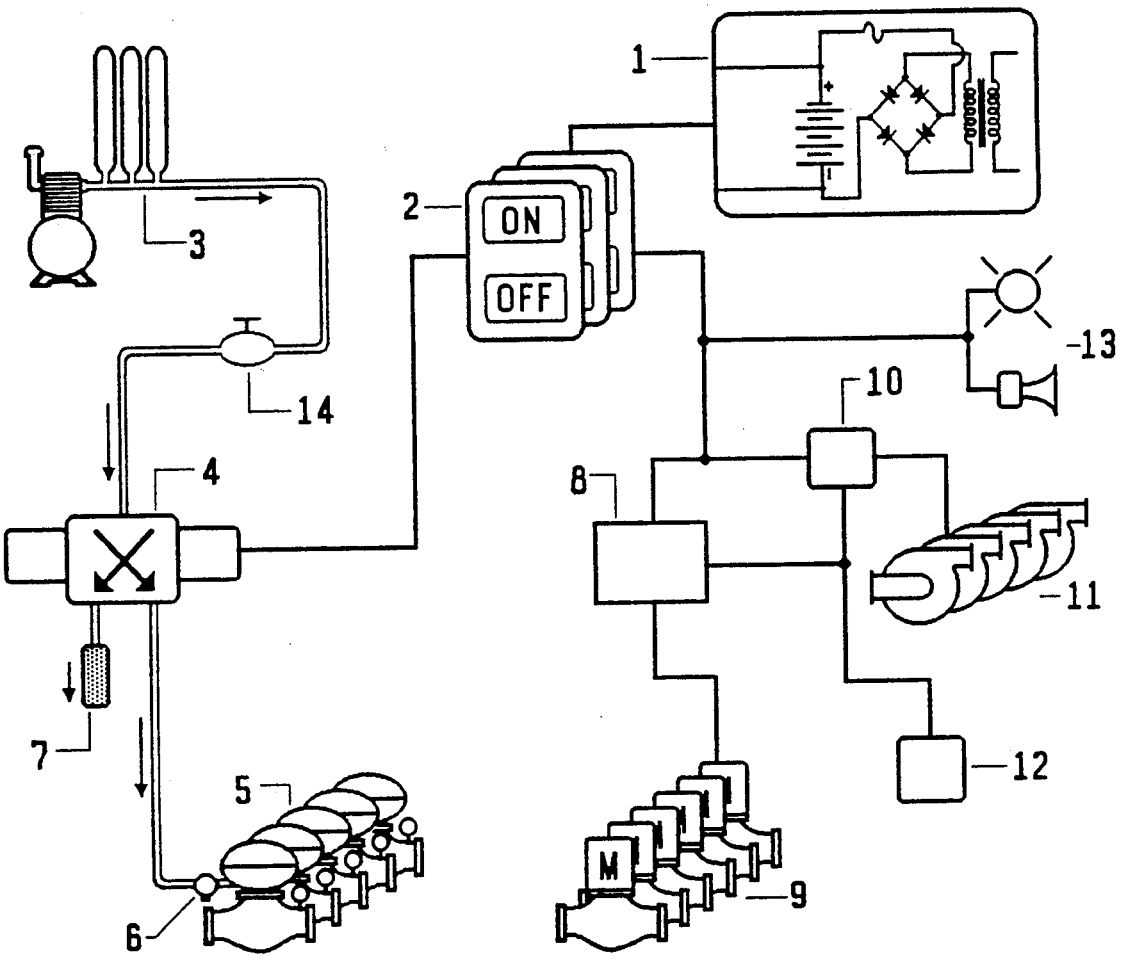
FIG. 10 is a block diagram showing relationship of the various elements of the control system.

FIG. 10 is a representation of the control system, presented in block diagram. Primary electrical power 1 for control system operation is from the ship's 115 VAC emergency lighting circuit, transformed to 13.5 VDC, with a 12 V battery backup to insure operation in the event of loss of ship's electrical power. System operating air is supplied from the ship's low pressure air system 3, through pressure reducer 14 at 50 psi. Electric power for operation of system valves 9, transfer pumps 11, and low pressure sensor 12 is provided from the ship's emergency power switchboard through existing transfer valve control systems 8 and transfer pump control system 10.

The control system is designed to be easily activated, from controller(s) 2, by depressing the momentary contact push-button, labeled "ON". Initial activation of controller 2, to the "ON" position, signals solenoid operated air supply valve 4 to shift such that it blocks ship's service low pressure air supply and vents operating air from ventlock valve diaphragm chambers 5 to atmosphere through vent 7, audible and visual alarms 13 are activated, distribution valves 9, through existing control system 8, are aligned for high tank suction and for discharge to distribution manifold, and transfer pumps 11, through existing control system 10, are started and maintained at speed sufficient to reduce pressure in suction manifold and all aligned tanks.

So long as the ship remains undamaged the pump suction manifold and all protected tanks will be maintained at a lower pressure than the outside water pressure and a slight static vacuum will be established in the top of each tank. Lowered pressure in the pump suction manifold is sensed by sensor 12 which signals valve alignment control system 8 to realign distribution valves 9 for recirculation for purposes of keeping the transfer pumps 11 cool.

Upon sustaining damage to one, or more, of the protected tanks, sensor 12 will react to rising pressure in the pump suction manifold to signal realignment of distribution valves 9 to stop recirculation and to align distribution such that oil from the damaged tank(s) will be transferred to predetermined receiving tank(s). At this point management of distribution valve(s) 9, through existing control system 8, and cargo pump(s) 11, through existing control system 10, may be manually undertaken by the cargo control Officer, or other cognizant crew member, for most desirable operation. Once manual system control has been taken, air supply to ventlock valves 5 installed in damaged tank(s) must be manually blocked and the diaphragm chamber vented to atmosphere, by rotation of plug valve 6, and the system must be turned "OFF" by activation of controller 2, thereby venting undamaged tanks to receive oil being transferred from damaged tanks.

Figure 11:
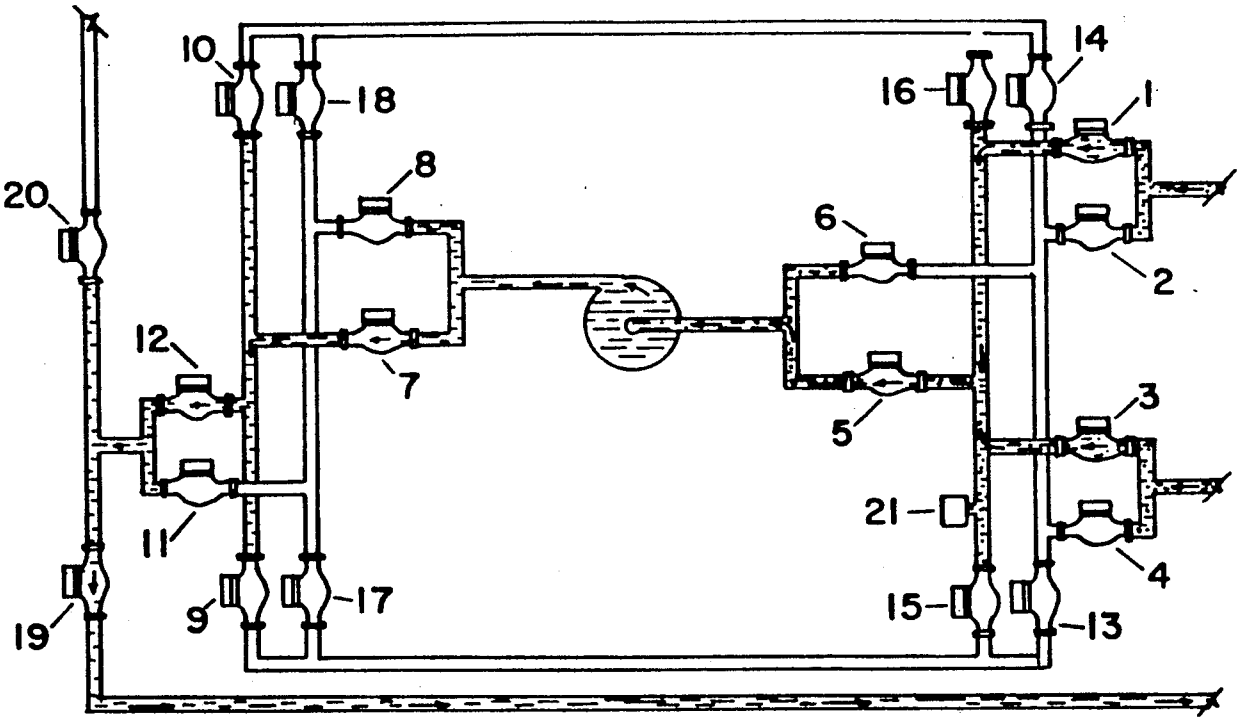
FIG. 11 represents a typical liquid load transfer arrangement for transit of restricted waters and prior to damage, indicating pump and valve alignment for recirculation of oil.

FIG. 11 represents a typical cargo oil distribution system which is shown active, as for transit of restricted waters, aligned for recirculation, due to sensor 21 reacting to low pressure in the pump suction manifold, with protected tank suction valves 1, recirculation tank valve 3, pump suction valve 5, pump discharge valve 7, manifold discharge valve 12, and recirculation valve 19 open, and with tank suction valves 2, and 4, pump suction valve 6, pump discharge valve 8, manifold valves 9, 10, 11, 13, 14, 15, 16, 17, 18, and cross connect valve 20 closed. Valve 20, heretofore not identified or discussed, is a direct connection for emergency distribution of oil to ballast and other normally segregated tanks.

Figure 12:
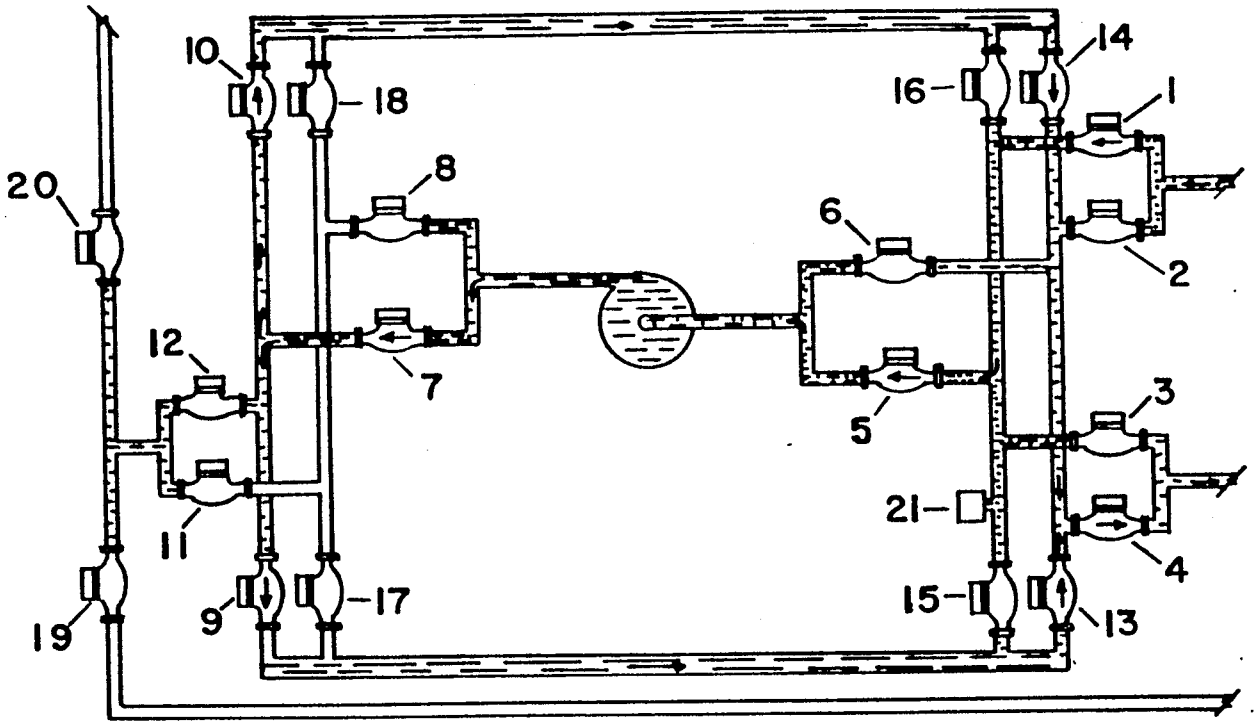
FIG. 12 represents a typical liquid load transfer arrangement subsequent to damage indicating pump and valve alignment for transfer of oil from damaged tank(s).

FIG. 12 represents a typical cargo oil distribution system which, due to sensor 21 reacting to rising pressure in the pump suction manifold is shown active, aligned for distribution of oil from protected tanks that have sustained under water damage, with protected tank suction valves 1, recirculation tank valve 4, pump suction valve 5, pump discharge valve 7, manifold discharge valve 9, 10, 12, 13, and 14, open, and with tank suction valves 2, and 3, pump suction valve 6, pump discharge valve 8, manifold valves 11, 15, 16, 17, 18, recirculation valve 19, and cross connect valve 20 closed.

While descriptions provided herein only address Transient Damage Strategy as it applies to bulk oil carrying ships, the scope of possibilities for protection is equally effective for war ships, dry cargo ships, passenger ships, barges, and all other waterborn craft that present a potential for pollution of waterways due to under water penetration of tanks, or for sinking due to flooding resulting from under water penetration of tanks.

Other benefits to be realized from the capability to safely seal tank vents while taking pump suction on tanks are only limited by imagination, such as preventing tank leakage, due to fatigue cracks, whether inboard or outboard, above or below the water.

We claim:

1. A TDS ventlock system which provides a vacuum to minimize leakage from a liquid carrying vessel including a tank, a tank vent, and a main tank valve located in the tank vent, said main valve including an operator controlled diaphragm, a diaphragm chamber and a spring such that during normal ship transit and during loading and unloading of the tank the main valve is held in an open position, in opposition to spring pressure from said spring by application of air pressure to the diaphragm chamber from the vessel's low pressure air system, whereupon tank damage the main valve reverts to a closed position via spring pressure upon loss or diversion of air pressure from the diaphragm chamber, or due to diaphragm failure, such that static vacuum will form in the top of the damaged tank to restrict leakage from the tank, thereby providing a fail safe system.

2. A system according to claim 1, including a vacuum/pressure gauge between the tank and the main valve to identify damage to the tank.

3. A system according to claim 1, wherein the tank contents level is maintained above the vessel's waterline to reduce outboard flow of the tank contents upon damage to the tank.

4. A system according to claim 1, whereby the main valve in a closed position seals the tank to prevent escape of air from the tank thereby preserving the vessel's stability and buoyancy.

5. A system according to claim 1, including an auxiliary valve located in the center of the main valve which is activated to an open position when pressure buildup within the tank exceeds a selected pressure to prevent over pressurization of the tank.

6. A system according to claim 2, wherein the vacuum/pressure gauge will indicate failure of the diaphragm and inadvertent valve closure by indicating an abnormal differential between ambient and tank pressures.

7. A system according to claim 1, including a manual operating mechanism for operation of the main valve to open position, upon failure of the diaphragm or loss of pressurized air supply.

8. A system according to claim 1, including sealing and retractable operating components for the main valve providing protection from deterioration and damage.

9. A TDS ventlock system which provides a vacuum to minimize leakage from a liquid carrying vessel including a tank, a tank vent, and a main tank valve located in the tank vent, said main valve including an operator controlled diaphragm, a diaphragm chamber and a spring such that during normal ship transit and during loading and unloading of the tank the main valve is held in an open position, in opposition to spring pressure from said spring by application of air pressure to the diaphragm chamber from the vessel's low pressure air system, whereupon tank damage the main valve reverts to a closed position via spring pressure upon loss or diversion of air pressure from the diaphragm chamber, or due to diaphragm failure, such that static vacuum will form in the top of the damaged tank to restrict leakage from the tank, thereby providing a fail safe system, and including an isolation valve to allow extraction of uncontaminated tank contents from a damaged tank.

10. A system according to claim 9, including tank content interface piping.

11. A system according to claim 9, including an interface piping connection to an existing tank content distribution system.

12. A system according to claim 9, including an interface piping connection to a pumping system.

13. A system according to claim 9, including a control system with single pushbutton switch activation for the main valve.

14. A system according to claim 13, which enables electric remote activation of the system upon loss of the vessel's electric power.

15. A system according to claim 13, which enables manual remote activation of the system upon component failure.

16. A system according to claim 13, which enables automatic operational sequencing of remote valve components.

17. A system according to claim 13, which enables automatic operational sequencing of remote pump components.

* * * * *